US009090430B2

(12) United States Patent
Miura et al.

(10) Patent No.: US 9,090,430 B2
(45) Date of Patent: Jul. 28, 2015

(54) LEAD WIRE PULL-OUT APPARATUS

(75) Inventors: Hideki Miura, Tokyo (JP); Shigeyuki Yonezawa, Tokyo (JP); Akio Yoshida, Tokyo (JP); Tomoyuki Nishinaka, Tokyo (JP); Hiroshi Kobayashi, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 0 days.

(21) Appl. No.: 13/814,784

(22) PCT Filed: Nov. 30, 2010

(86) PCT No.: PCT/JP2010/071332
§ 371 (c)(1),
(2), (4) Date: Feb. 7, 2013

(87) PCT Pub. No.: WO2012/073318
PCT Pub. Date: Jun. 7, 2012

(65) Prior Publication Data
US 2013/0153704 A1 Jun. 20, 2013

(51) Int. Cl.
*B65H 23/16* (2006.01)
*B65H 59/10* (2006.01)
*B65H 77/00* (2006.01)
(Continued)

(52) U.S. Cl.
CPC ..... *B65H 51/28* (2013.01); *B65H 49/18* (2013.01); *B65H 51/20* (2013.01); *B65H 59/36* (2013.01); *B65H 2701/36* (2013.01)

(58) Field of Classification Search
CPC .... G03B 1/54; B65H 2220/01; B65H 222/02; B65H 23/1825; B65H 23/1955
USPC ..... 242/413, 413.3, 416, 417, 417.3, 419, 242/419.1
See application file for complete search history.

(56) References Cited

U.S. PATENT DOCUMENTS 1,475,855 A * 11/1923 Murdock ..... 242/419.1
2,555,045 A * 5/1951 Lind ..... 242/485.2
(Continued)

FOREIGN PATENT DOCUMENTS

CN 101218088 A 7/2008
DE 3205901 A1 * 9/1983 ..... G03B 1/54
(Continued)

OTHER PUBLICATIONS

International Preliminary Report on Patentability issued Jun. 13, 2013 in PCT/JP2010/071332 filed on Nov. 30, 2010 (English translation only).
(Continued)

*Primary Examiner* — Emmanuel M Marcelo
*Assistant Examiner* — Michael Gallion
(74) *Attorney, Agent, or Firm* — Oblon, McClelland, Maier & Neustadt, L.L.P.

(57) ABSTRACT

A lead wire pull-out apparatus includes: a lead reel configured to have a lead wire wound thereon; two fixed lead bearings fixed at predetermined positions, on which the lead wire pulled out from the lead reel is slidable; a movable lead bearing arranged between the two fixed lead bearings, the movable lead bearing being movable in a vertical direction and configured such that a lower portion thereof is able to be in contact with the lead wire; and a press-down part configured to press down the movable lead bearing.

3 Claims, 3 Drawing Sheets

(51) Int. Cl.

| | |
|---|---|
| ***B65H 51/28*** | (2006.01) |
| ***B65H 49/18*** | (2006.01) |
| ***B65H 51/20*** | (2006.01) |
| ***B65H 59/36*** | (2006.01) |

(56) References Cited

U.S. PATENT DOCUMENTS

| | | | | | |
|---|---|---|---|---|---|
| 2,696,192 | A | * | 12/1954 | Birchler et al. | 118/34 |
| 2,922,594 | A | * | 1/1960 | Pawlowski | 242/413.4 |
| 2,988,297 | A | * | 6/1961 | Pawlowski | 242/413.4 |
| 3,241,785 | A | * | 3/1966 | Barrett | 242/413.1 |
| 3,335,928 | A | * | 8/1967 | Angell | 226/39 |
| 3,391,877 | A | * | 7/1968 | Angell et al. | 242/554.1 |
| 3,446,447 | A | * | 5/1969 | Rosca | 242/419 |
| 3,540,674 | A | * | 11/1970 | Shiro | 242/147 R |
| 3,593,939 | A | * | 7/1971 | Bolles | 242/413.4 |
| 3,731,889 | A | * | 5/1973 | Alexeff | 242/156.2 |
| 3,813,052 | A | * | 5/1974 | Swann et al. | 242/420.3 |
| 3,913,855 | A | * | 10/1975 | Heimlicher et al. | 242/421.6 |
| 4,015,799 | A | * | 4/1977 | Koski et al. | 242/334.4 |
| 4,634,070 | A | * | 1/1987 | Looper | 242/413.3 |
| 4,642,868 | A | * | 2/1987 | Pandell | 29/429 |
| 4,709,872 | A | * | 12/1987 | Hammer et al. | 242/421.6 |
| 5,209,415 | A | * | 5/1993 | Brouwer et al. | 242/417 |
| 5,228,635 | A | * | 7/1993 | Tanaka et al. | 242/413.3 |
| 6,375,112 | B1 | * | 4/2002 | Engelhardt | 242/419.2 |
| 6,547,707 | B2 | * | 4/2003 | Cote | 493/13 |
| 6,945,490 | B1 | * | 9/2005 | Zollinger | 242/419.1 |
| 6,978,962 | B1 | * | 12/2005 | Fore et al. | 242/474.4 |
| 7,454,162 | B2 | * | 11/2008 | Segerer et al. | 399/407 |
| 8,119,055 | B2 | * | 2/2012 | Pellengo Gatti | 264/505 |
| 2008/0283567 | A1 | * | 11/2008 | Yang | 226/1 |
| 2009/0206191 | A1 | * | 8/2009 | Dunkmann et al. | 242/417 |

FOREIGN PATENT DOCUMENTS

| | | |
|---|---|---|
| JP | 58 144054 | 8/1983 |
| JP | 9 52662 | 2/1997 |
| JP | 11 54678 | 2/1999 |
| JP | 2004 122204 | 4/2004 |
| JP | 3105543 | 11/2004 |
| JP | 2008 155240 | 7/2008 |
| TW | M378925 U | 4/2010 |

OTHER PUBLICATIONS

Written Opinion issued Jan. 11, 2011 in PCT/JP2010/071332 filed on Nov. 30, 2010 (with English translation).

International Search Report Issued Jan. 11, 2011 in PCT/JP10/71332 Filed Nov. 30, 2010.

Taiwanese Search Report issued Mar. 5, 2014 in Patent Application No. 100124888 with English Translation of Categories of Cited Documents.

Chinese Search Report issued Feb. 19, 2014, in China Patent Application No. 2010800700634 (with Partial English translation).

* cited by examiner

LEAD WIRE PULL-OUT APPARATUS

TECHNICAL FIELD

The present invention relates to a lead wire pull-out apparatus, and the present invention is usable, for example, in an ultrasonic vibration bonding process.

BACKGROUND ART

For bonding a conductive material, or the like, to a processing object, an ultrasonic vibration bonding process has been conventionally adopted (for example, see Patent Documents 1 and 2).

For example, for bonding a line-shaped conductive member (hereinafter referred to as a lead wire) onto a substrate, the following technique is adopted. The lead wire is wound on a lead reel multiple times, and the lead wire is pulled out from this lead reel. Then, at a predetermined position on the substrate, the pulled-out lead wire is brought into contact with the substrate, and, at this contact portion, an ultrasonic vibration bonding process is performed on the lead wire.

PRIOR-ART DOCUMENTS

Patent Documents

Patent Document 1: Japanese Patent Application Laid-Open No. 1999-54678

Patent Document 2: Japanese Patent Application Laid-Open No. 2008-155240

SUMMARY OF THE INVENTION

Problems to be Solved by the Invention

Since it is necessary that the lead wire is wound on the lead reel multiple times, the lead reel itself has a large size and a large weight. Moreover, the lead wire is wound on the lead reel multiple times. Accordingly, the lead reel having the lead wire wound thereon has a still larger weight.

Therefore, when the lead wire is directly pulled out from the lead reel onto the substrate, an extremely high tension acts on the lead wire due to the inertia. In many cases, a lead wire having an extremely small thickness of about a few tenths of a millimeter is adopted. If the above-mentioned extremely high tension is applied to such a lead wire, a break of the lead wire, or the like, occurs.

Therefore, an object of the present invention is to provide a lead wire pull-out apparatus that can prevent a break of a lead wire even when the lead wire is pulled out from a lead reel.

Means for Solving the Problems

To attain the above-mentioned object, a lead wire pull-out apparatus according to the present invention includes: a lead reel configured to have a lead wire wound thereon; two fixed lead bearings fixed at predetermined positions, on which the lead wire pulled out from the lead reel is slidable; a movable lead bearing arranged between the two fixed lead bearings, the movable lead bearing being movable in a vertical direction and configured such that a lower portion thereof is able to be in contact with the lead wire; and a press-down part configured to press down the movable lead bearing.

Effects of the Invention

The lead wire pull-out apparatus according to the present invention includes: the lead reel configured to have the lead wire wound thereon; the two fixed lead bearings fixed at the predetermined positions, on which the lead wire pulled out from the lead reel is slidable; the movable lead bearing arranged between the two fixed lead bearings, the movable lead bearing being movable in the vertical direction and configured such that the lower portion thereof is able to be in contact with the lead wire; and the press-down part configured to press down the movable lead bearing.

Accordingly, when the lead wire is pulled out to the working operation side, only tension corresponding to the own weight of the movable lead bearing acts on the lead wire. Therefore, use of the lead pull-out apparatus according to the present invention can reduce the tension acting on the lead wire, even when the lead wire is pulled out to the working operation side. Thus, use of the lead pull-out apparatus according to the present invention can prevent a break of the lead wire at the working operation side.

These and other objects, features, aspects and advantages of the present invention will become more apparent from the following detailed description of the present invention when taken in conjunction with the accompanying drawings.

EMBODIMENT FOR CARRYING OUT THE INVENTION

In the following, with reference to the drawings, a specific description will be given to a lead wire pull-out apparatus according to the present invention, taking as an example a case where it is used for an ultrasonic vibration bonding process.

Embodiment

Figure 1:
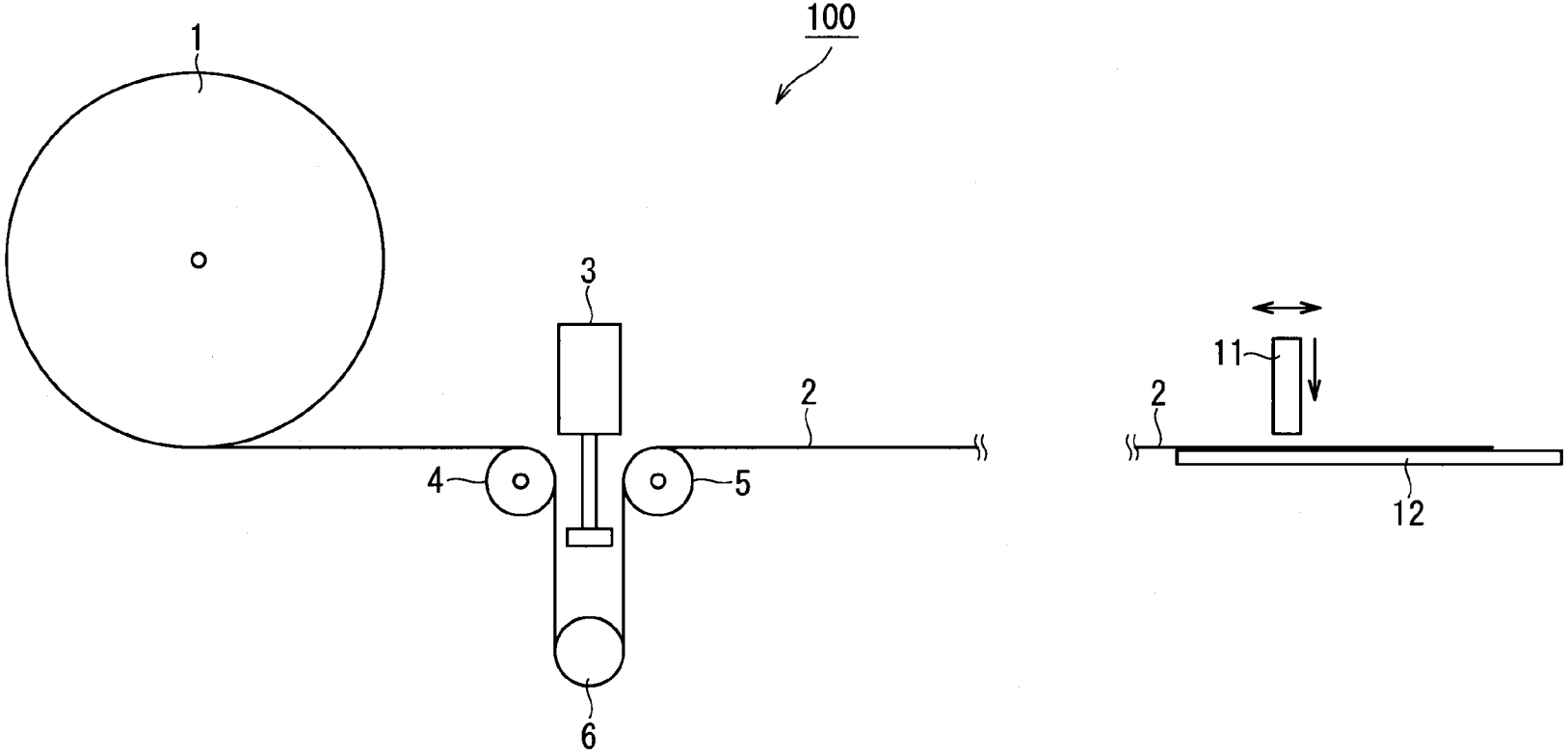
FIG. 1 A diagram showing an outline configuration of a lead wire pull-out apparatus 100 according to the present invention.

FIG. 1 is a diagram showing an outline configuration of a lead wire pull-out apparatus 100 according to the present invention. In FIG. 1, the lead wire pull-out apparatus 100 is used in a situation where a lead wire 2 is bonded to a substrate 12 by means of ultrasonic vibration bonding.

The lead wire pull-out apparatus 100 includes a lead reel 1, a press-down part 3, a first fixed lead bearing 4, a second fixed lead bearing 5, and a movable lead bearing 6.

The lead wire 2 is wound on the lead reel 1 multiple times. The lead wire 2 has a line shape with a small film thickness and is, for example, an aluminum wire or a copper wire. In one example, the lead wire 2 has a line width of about a few millimeters and a thickness of about a few tenths of a millimeter.

The lead wire 2 pulled out from the lead reel 1 is firstly received by the first fixed lead bearing 4. The first fixed lead bearing 4 is fixed at a predetermined position, and the lead wire 2 is slidable on the first fixed lead bearing 4.

The second fixed lead bearing 5 is fixed at a position farther from the lead reel 1 than the first fixed lead bearing 4 is. The position where the second fixed lead bearing 5 is fixed and the position where the first fixed lead bearing 4 is fixed is at a predetermined distance from each other. The lead wire 2 having passed through the first fixed lead bearing 4 is also slidable on the second fixed lead bearing 5. In the configuration shown in FIG. 1, the position where the first fixed lead bearing 4 is fixed and the position where the second fixed lead bearing 5 is fixed are at the same height.

The movable lead bearing 6 is arranged between the first fixed lead bearing 4 and the second fixed lead bearing 5. The position of the movable lead bearing 6 is not fixed, and the movable lead bearing 6 is movable in the vertical direction in FIG. 1. More specifically, the movable lead bearing 6 is vertically movable within a range below the positions where the fixed lead bearings 4 and 5 are fixed (in other words, the movable lead bearing 6 does not move beyond the positions where the fixed lead bearings 4 and 5 are fixed).

In a state where the lead wire 2 spans between the first fixed lead bearing 4 and the second fixed lead bearing 5, the lead wire 2 is in contact with a lower portion of the movable lead bearing 6. That is, the movable lead bearing 6 is put on the lead wire 2 spanning between the first fixed lead bearing 4 and the second fixed lead bearing 5. As shown in FIG. 1, the lead wire 2 spanning between the first fixed lead bearing 4 and the second fixed lead bearing 5 hangs down with the movable lead bearing 6.

The size (diameter) of the movable lead bearing 6 is smaller than the size (diameter) of the lead reel 1. The weight of the movable lead bearing 6 is smaller than the weight of the lead reel 1. For example, the weight of the movable lead bearing 6 is about 100 to 200 grams, while the weight of the lead reel 1 is a few kilograms.

The press-down part 3, which is an actuator of air type, hydraulic type, electric motor type, or the like, is movable in the vertical direction in FIG. 1. Due to a pressing-down force of the press-down part 3, the movable lead bearing 6 together with the lead wire 2 is pressed downward in FIG. 1.

As shown in FIG. 1, the lead wire 2 having passed through the second fixed lead bearing 5 is pulled out onto the substrate 12. A ultrasonic vibration tool 11 is brought into contact with the lead wire 2 on the substrate 12 at a desired position, and the ultrasonic vibration tool 11 is vibrated in a direction of the horizontal plane of FIG. 1. Thus, via the ultrasonic vibration tool 11, predetermined pressure acting downward in FIG. 1 is applied to the lead wire 2. As a result, the lead wire 2 is bonded onto the substrate 12 at the desired position.

Here, a region where an operation such as the ultrasonic vibration bonding is performed on the pulled-out lead wire 2 will be referred to as a working operation side.

Next, an operation of the lead wire pull-out apparatus 100 according to the present invention will be described.

Figure 2:
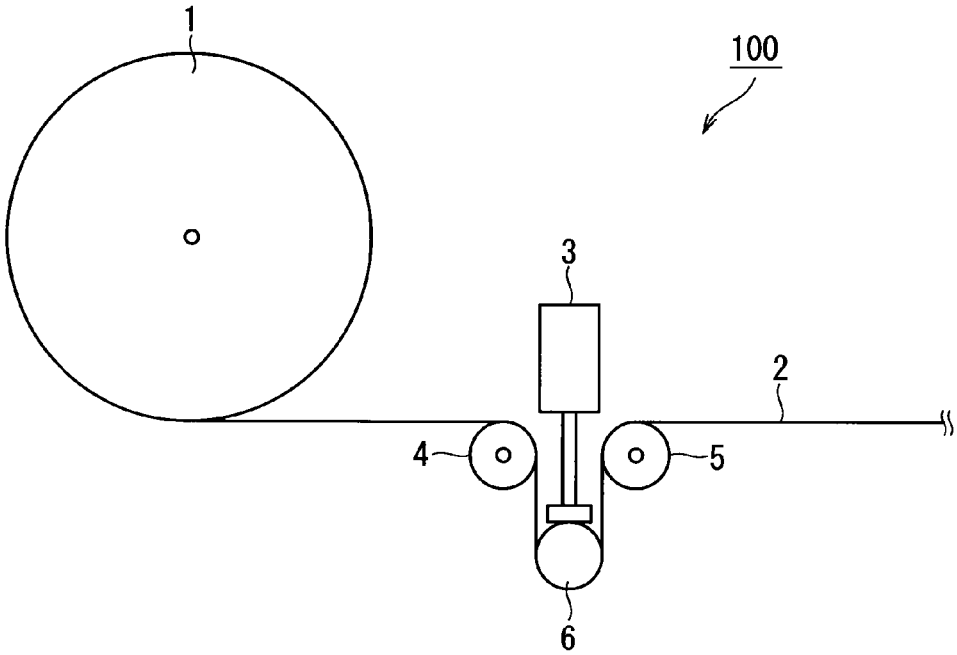
FIG. 2 A diagram for explaining an operation of the lead wire pull-out apparatus 100 according to the present invention.
Figure 3:
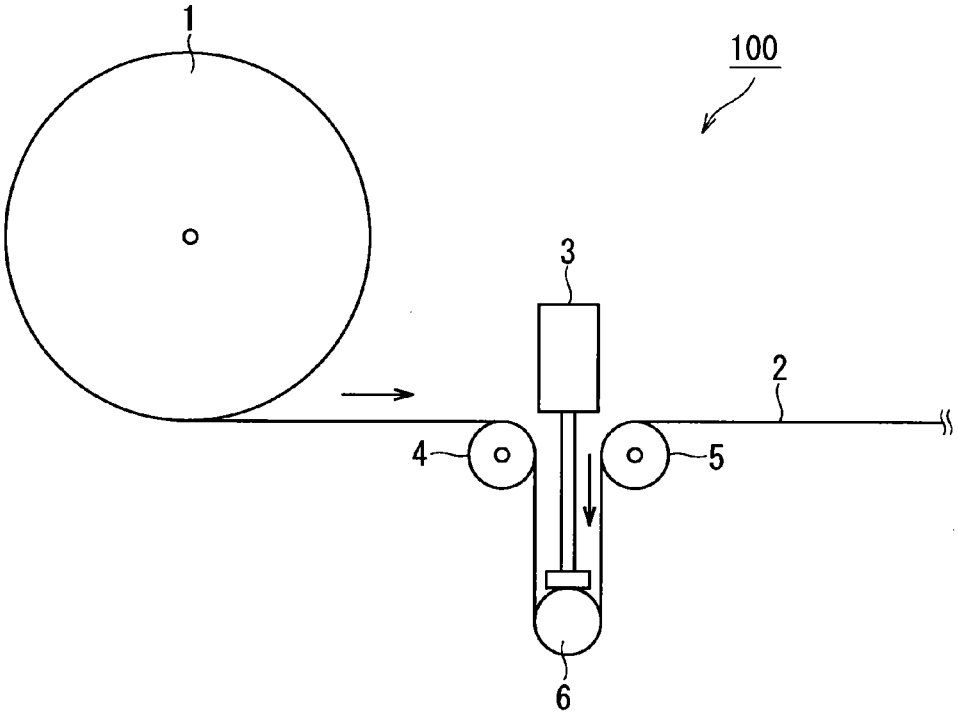
FIG. 3 A diagram for explaining the operation of the lead wire pull-out apparatus 100 according to the present invention.

In the lead wire pull-out apparatus 100 having a state shown in FIG. 2, the press-down part 3 presses the movable lead bearing 6 downward due to the pressing-down force, as shown in FIG. 3. The downward movement of the movable lead bearing 6 causes the lead wire 2 that is in contact with the lower portion of the movable lead bearing 6 to also sag down. Thus, as shown in FIG. 3, a predetermined amount of the lead wire 2 is pulled out from the lead reel 1 (a portion of the lead wire 2 at the far side of the second fixed lead bearing 5 is substantially not moved). For example, an operation shown in FIG. 3 is performed during ultrasonic vibration bonding process described above.

Figure 4:
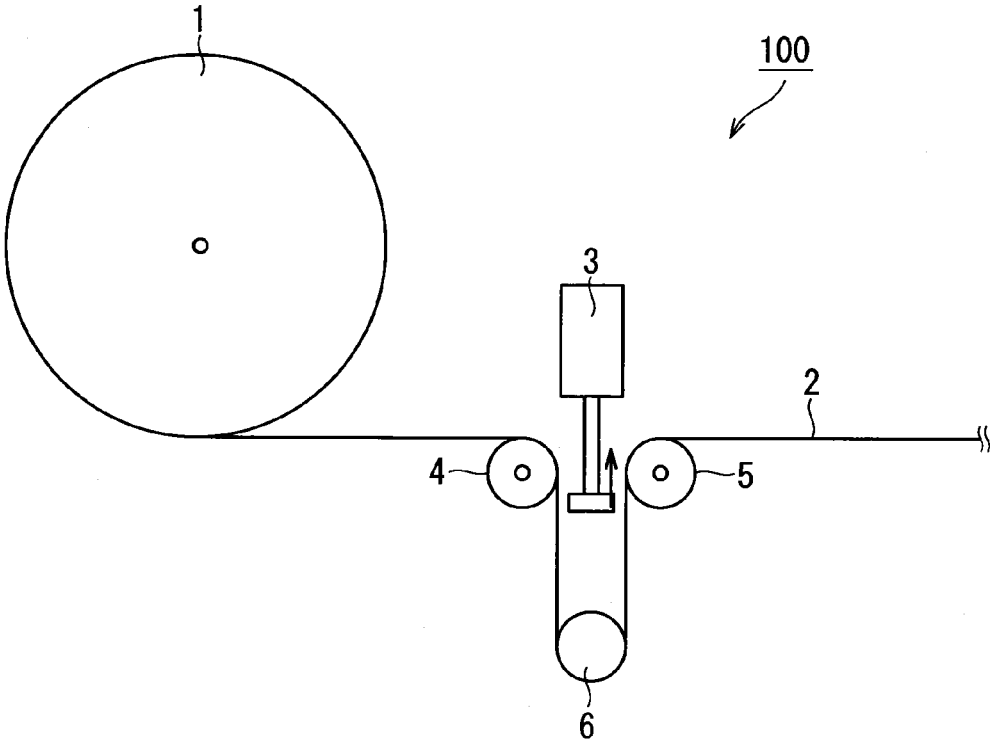
FIG. 4 A diagram for explaining the operation of the lead wire pull-out apparatus 100 according to the present invention.

Then, the press-down part 3 removes the pressing-down force. That is, as shown in FIG. 4, the press-down part 3 moves upward, and its contact with the movable lead bearing 6 is removed. Here, even though the pressing-down force is removed, the movable lead bearing 6 does not move upward but remains fixed at a position to which the movable lead bearing 6 has been pressed down. Additionally, even though the pressing-down force is removed, the lead wire 2 does not move. For example, an operation shown in FIG. 4 is performed during the ultrasonic vibration bonding process described above.

Figure 5:
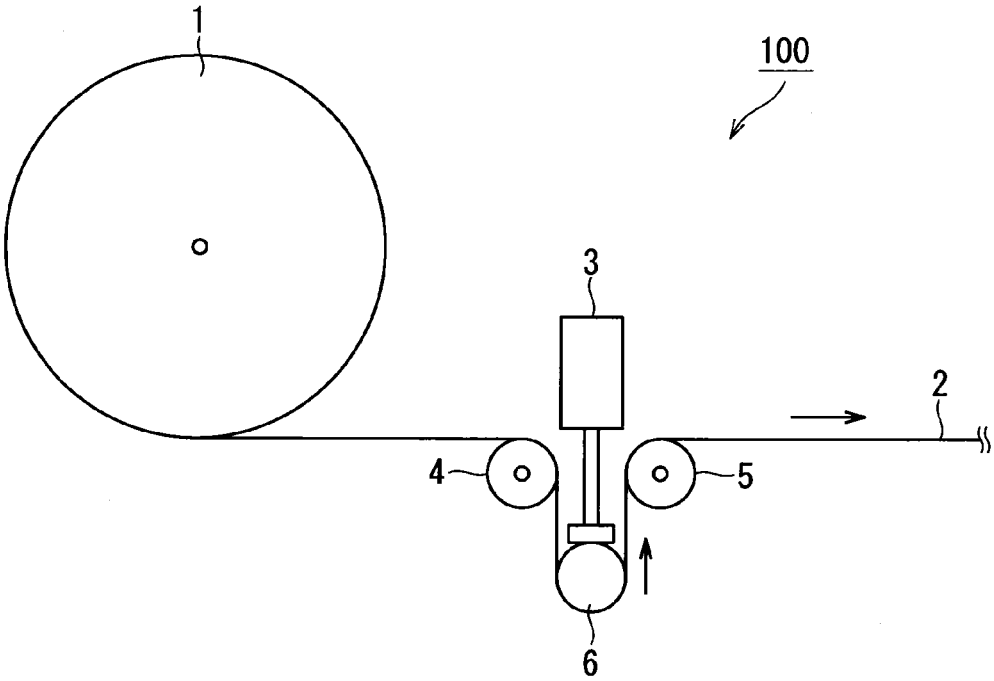
FIG. 5 A diagram for explaining the operation of the lead wire pull-out apparatus 100 according to the present invention.

Then, the lead wire 2 is pulled out at the second fixed lead bearing 5 side (in other words, the lead wire 2 is pulled out to the working operation side). As a result, as shown in FIG. 5, the lead wire 2 having sagged down moves upward together with the movable lead bearing 6. Here, the lead reel 1 does not move during the operation of pulling out the lead wire 2.

Accordingly, in an operation for pulling out the lead wire 2 shown in FIG. 5, tension applied to the lead wire 2 corresponds to only half the own weight of the movable lead bearing 6. To be more specific, since the size and weight of the movable lead bearing 6 are smaller than the size and weight of the lead reel 1, tension applied to the lead wire 2 can be reduced as compared with when the lead wire 2 is pulled out directly from the lead reel 1 to the working operation side.

For example, the operation shown in FIG. 5 is performed in a time period after the ultrasonic vibration bonding process is completed and before the next ultrasonic vibration bonding process is performed.

The lead wire pull-out apparatus 100 repeatedly performs the operations shown in FIG. 2→FIG. 3→FIG. 4→FIG. 4→FIG. 5→FIG. 3 . . . .

As described above, in the lead wire pull-out apparatus 100 according to the present invention, the movable lead bearing 6 is pressed down to pull out the lead wire 2 from the lead reel 1 side, and then the lead wire 2 is pulled out from the second fixed lead bearing 5 side. Here, since the lead wire 2 is not wound on the movable lead bearing 6, the weight of the movable lead bearing 6 is smaller than that of the lead reel 1.

Accordingly, when the lead wire 2 is pulled out from the second fixed lead bearing 5 side (when the lead wire 2 is pulled out to the working operation side), only the tension corresponding to half the own weight of the movable lead bearing 6 acts on the lead wire 2. Therefore, use of the lead pull-out apparatus 100 according to the present invention can reduce the tension acting on the lead wire 2, as compared with a case where the lead wire 2 is pulled out to the working operation side directly from the lead reel 1 having a large diameter and a large weight. Thus, use of the lead pull-out apparatus 100 according to the present invention can prevent a break of the lead wire 2 at the working operation side.

By setting the size (diameter) of the movable lead bearing 6 smaller than the size (diameter) of the lead reel 1, and by setting the weight of the movable lead bearing 6 smaller than the weight of the lead reel 1 itself, the tension applied to the lead wire 2 at a time when the lead wire 2 is pulled out to the working operation side can be further reduced.

While the invention has been shown and described in detail, the foregoing description is in all aspects illustrative and not restrictive. It is therefore understood that numerous modifications and variations can be devised without departing from the scope of the invention.

DESCRIPTION OF THE REFERENCE NUMERALS

1 lead reel
2 lead wire

3 press-down part
4 first fixed lead bearing
5 second fixed lead bearing
6 movable lead bearing
11 ultrasonic vibration tool
12 substrate
100 lead wire pull-out apparatus

The invention claimed is:

1. A lead wire pull-out apparatus comprising:

a lead reel configured to have a lead wire wound thereon;

two fixed lead bearings fixed at predetermined positions, on which said lead wire pulled out from said lead reel is slidable;

a movable lead bearing arranged between said two fixed lead bearings, said movable lead bearing being movable in a vertical direction and configured such that a lower portion thereof is able to be in contact with said lead wire; and a press-down part configured to contact and press down said movable lead bearing, wherein said press-down part presses down said movable lead bearing by a predetermined pressing-down force to thereby pull out said lead wire from said lead reel, and then removes said pressing-down force after said lead wire is pulled out, wherein after said pressing-down force is removed, the press-down part is separated from the movable lead bearing so as to be out of contact with the movable lead bearing, and after the press-down part is separated from the movable lead bearing, said lead pull-out apparatus pulls the lead wire from a side where said lead reel does not exist.

2. The lead wire pull-out apparatus according to claim 1, wherein the size of said movable lead bearing is smaller than the size of said lead reel.

3. The lead wire pull-out apparatus according to claim 1, wherein the weight of said movable lead bearing is smaller than the weight of said lead reel.

* * * * *